US007695256B2

(12) United States Patent
Horng et al.

(10) Patent No.: US 7,695,256 B2
(45) Date of Patent: Apr. 13, 2010

(54) MINIATURE FAN

(75) Inventors: Alex Horng, Kaohsiung (TW); Tso-Kuo Yin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 12 days.

(21) Appl. No.: 12/193,074

(22) Filed: Aug. 18, 2008

(65) Prior Publication Data

US 2010/0028177 A1 Feb. 4, 2010

(30) Foreign Application Priority Data

Jul. 29, 2008 (TW) ..... 97128615 A

(51) Int. Cl.
*F04B 17/00* (2006.01)

(52) U.S. Cl. ..... 417/420

(58) Field of Classification Search ..... 417/352, 417/353, 420, 423.7, 423.14; 416/235, 236 R; 361/695; 310/423.14
See application file for complete search history.

(56) References Cited

U.S. PATENT DOCUMENTS 4,128,364 A * 12/1978 Papst et al. ..... 417/354
4,164,690 A * 8/1979 Muller et al. ..... 318/400.41
4,603,271 A * 7/1986 Maruyama et al. ..... 310/62
4,620,139 A * 10/1986 Egami et al. ..... 318/400.01
5,176,509 A * 1/1993 Schmider et al. ..... 417/423.7
5,742,107 A * 4/1998 Asao et al. ..... 310/62
6,805,536 B2 * 10/2004 Hung ..... 416/244 R
6,896,476 B2 * 5/2005 Hung ..... 415/10
7,040,862 B2 * 5/2006 Otsuka ..... 415/214.1
7,157,818 B2 * 1/2007 Jones ..... 310/63
7,381,027 B2 * 6/2008 Kaneko et al. ..... 415/206
7,455,501 B2 * 11/2008 Horng et al. ..... 415/220
7,503,746 B2 * 3/2009 Liu et al. ..... 415/204
7,619,337 B2 * 11/2009 Kasai et al. ..... 310/89
2001/0023759 A1 * 9/2001 Katsui ..... 165/125
2003/0173916 A1 * 9/2003 Nelson et al. ..... 318/268
2003/0231968 A1 * 12/2003 Hsieh ..... 417/353
2005/0031464 A1 * 2/2005 Huang ..... 417/352
2005/0063817 A1 * 3/2005 Park ..... 415/170.1
2005/0093383 A1 * 5/2005 Wu et al. ..... 310/67 R
2005/0104459 A1 * 5/2005 Jones ..... 310/63
2007/0114868 A1 * 5/2007 Horng et al. ..... 310/156.32
2007/0114869 A1 * 5/2007 Horng et al. ..... 310/156.32
2007/0176508 A1 * 8/2007 Kasai et al. ..... 310/156.32
2007/0196221 A1 8/2007 Horng et al.
2007/0212219 A1 * 9/2007 Teshima et al. ..... 415/206
2008/0138216 A1 * 6/2008 Ye ..... 417/353
2009/0016914 A1 * 1/2009 Chen et al. ..... 417/423.7
2009/0035162 A1 * 2/2009 Yan et al. ..... 417/423.7
2009/0041601 A1 * 2/2009 Sun et al. ..... 417/423.12
2009/0053063 A1 * 2/2009 Liang et al. ..... 416/174
2009/0079303 A1 * 3/2009 Zhang et al. ..... 310/67 R

* cited by examiner

*Primary Examiner*—Devon C Kramer
*Assistant Examiner*—Amene S Bayou
(74) *Attorney, Agent, or Firm*—Alan Kamrath; Kamrath & Associates PA

(57) ABSTRACT

A miniature fan includes a base and a stator mounted in the base. A rotor includes a hub having a plurality of blades on an outer periphery thereof. A magnetically sealing ring includes first and second engaging faces. The first engaging face is coupled to a bottom edge of each blade. A permanent magnet is coupled to the second engaging face of the magnetically sealing ring and aligned with the stator. Given the same air output, the miniature fan has a reduced volume.

17 Claims, 7 Drawing Sheets

MINIATURE FAN

BACKGROUND OF THE INVENTION

1. Field of the Invention

The present invention relates to a miniature fan and, more particularly, to a blower-type miniature fan that outputs air from a lateral side thereof.

2. Description of the Related Art

FIGS. 1 and 2 show a typical conventional blower-type fan 9 including a base 91 in the form of a hollow housing having an air outlet 911 in a lateral side thereof and an opening 912 in a top side thereof. A stator 92 is mounted in base 91. A rotor 93 includes a hub 931 rotatably received in base 91. A metal ring 932 is coupled to an inner periphery of hub 931, and a permanent magnet 933 is coupled to an inner periphery of metal ring 932, so that metal ring 932 is located between hub 931 and permanent magnet 933 to provide a magnetically sealing effect. An annular plate 934 extends radially outward from and is integrally formed with an outer periphery of hub 931. A plurality of blades 935 are mounted on a top face of annular plate 934 and spaced from one another at regular intervals. A cover 94 is mounted on top of base 91 and includes an air inlet 941 aligned with opening 912 of base 91.

In use, flux linkage between stator 92 and permanent magnet 933 causes rotation of rotor 93 to draw airflow into fan 9 from air inlet 941. Airflow drawn into fan 9 accumulates between cover 94 and base 91 and is then driven by rotor 93 to the environment via air outlet 911 to provide a heat-dissipating effect. However, the outer diameter D of hub 931 of fan 9 must be large enough to receive metal ring 932 and permanent magnet 933 that are both mounted inside hub 931. As a result, the overall size of fan 9 can not be effectively minimized; namely, miniaturization of fan 9 is not easy.

SUMMARY OF THE INVENTION

The primary objective of the present invention is to provide a miniature fan whose volume can be reduced without reducing the air output.

Another objective of the present invention is to provide a miniature fan that has a simpler structure to allow easier assembly.

A miniature fan according to the preferred teachings of the present invention includes a base having a compartment in which a shaft tube is mounted. The base further includes an opening in a top side thereof and an air outlet in a lateral side thereof. The opening and the air outlet are in communication with the compartment. A stator is mounted in the compartment of the base. A rotor includes a hub and a shaft mounted to the hub. The shaft rotatably extends through the shaft tube of the base in an axial direction. The hub includes a plurality of blades formed on an outer periphery thereof. A magnetically sealing ring includes first and second engaging faces spaced in the axial direction. The first engaging face is coupled to a bottom edge of each blade. The magnetically sealing ring further includes a positioning hole through which the hub extends. A permanent magnet is coupled to the second engaging face of the magnetically sealing ring and aligned with the stator. Given the same air output, the miniature fan according to the preferred teachings of the present invention has a smaller volume than conventional miniature fans.

Preferably, the hub includes an annular wall extending in the axial direction, and the shaft tube is received inside the annular wall, preventing dust from entering an interior of the shaft tube.

Preferably, an inner periphery of the positioning hole of the magnetically sealing ring is fixed to an outer periphery of the annular wall of the hub, providing reliable coupling between the magnetically sealing ring and the hub.

Preferably, the bottom edge of each blade of the rotor includes a notch, and the magnetically sealing ring is engaged in the notch of each blade, further reducing the height in the axial direction of the miniature fan according to the preferred teachings of the present invention.

Preferably, the notch of each blade includes a bottom edge and an end edge. The first engaging face of the magnetically sealing ring abuts the bottom edge of the notch of each blade, and an outer periphery of the magnetically sealing ring extending between the first and second engaging faces abuts the end edge of the notch of each blade, preventing the magnetically sealing ring from falling.

Each blade includes an air inlet side and an air driving side. An angle between the air driving side of each blade and a horizontal plane on which the first engaging face of the magnetically sealing ring lies is preferably larger than 10° and smaller than 90°, providing an airflow accumulation area between the air driving side of each blade and the first engaging face of the magnetically sealing ring for effectively accumulating airflow.

Preferably, the air driving side of each blade is a concave face, and an angle between any tangent of the air driving side of each blade and the horizontal plane is larger than 10° and smaller than 90°.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
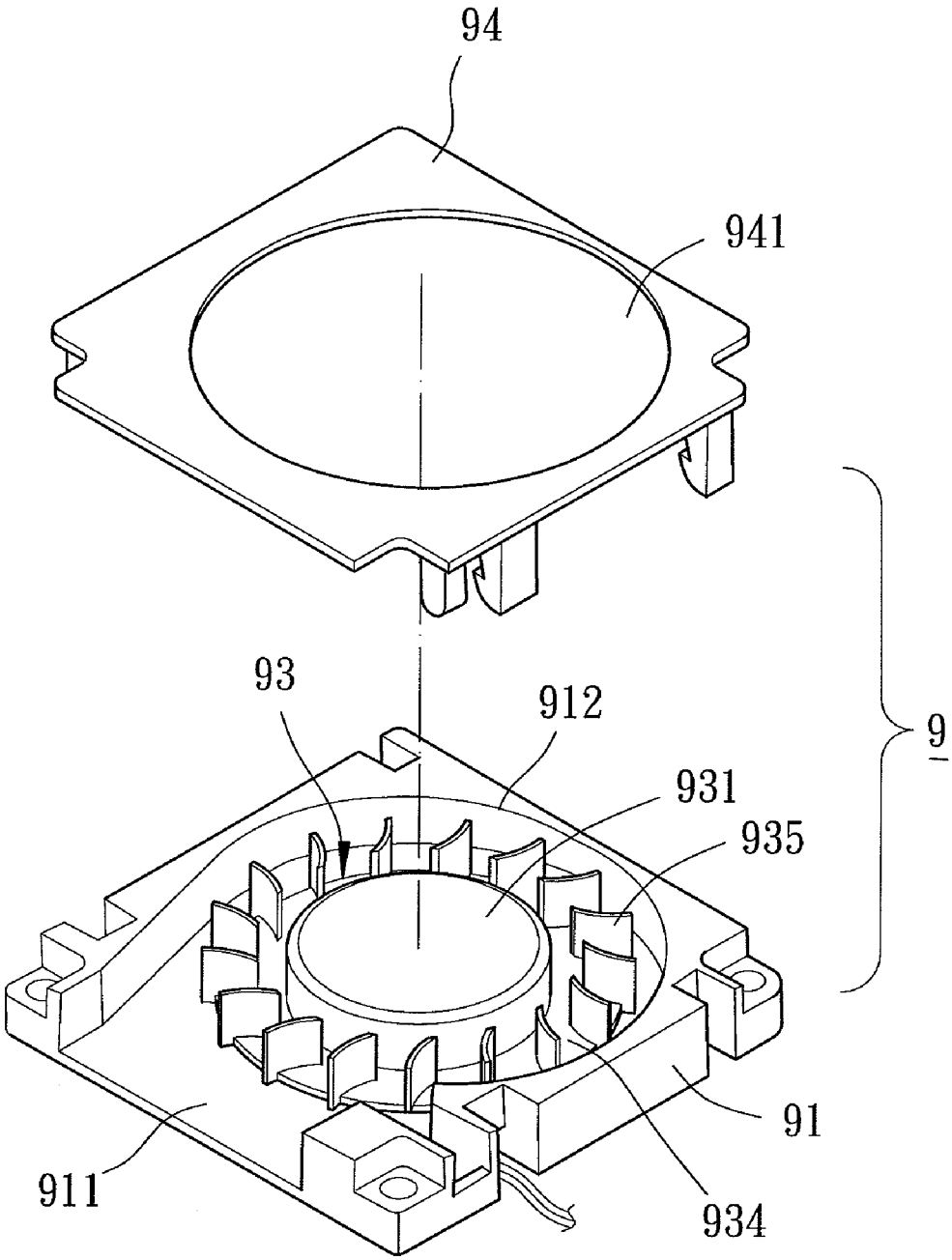
FIG. 1 PRIOR ART
FIG. 1 shows an exploded, perspective view of a conventional miniature fan.
Figure 2:
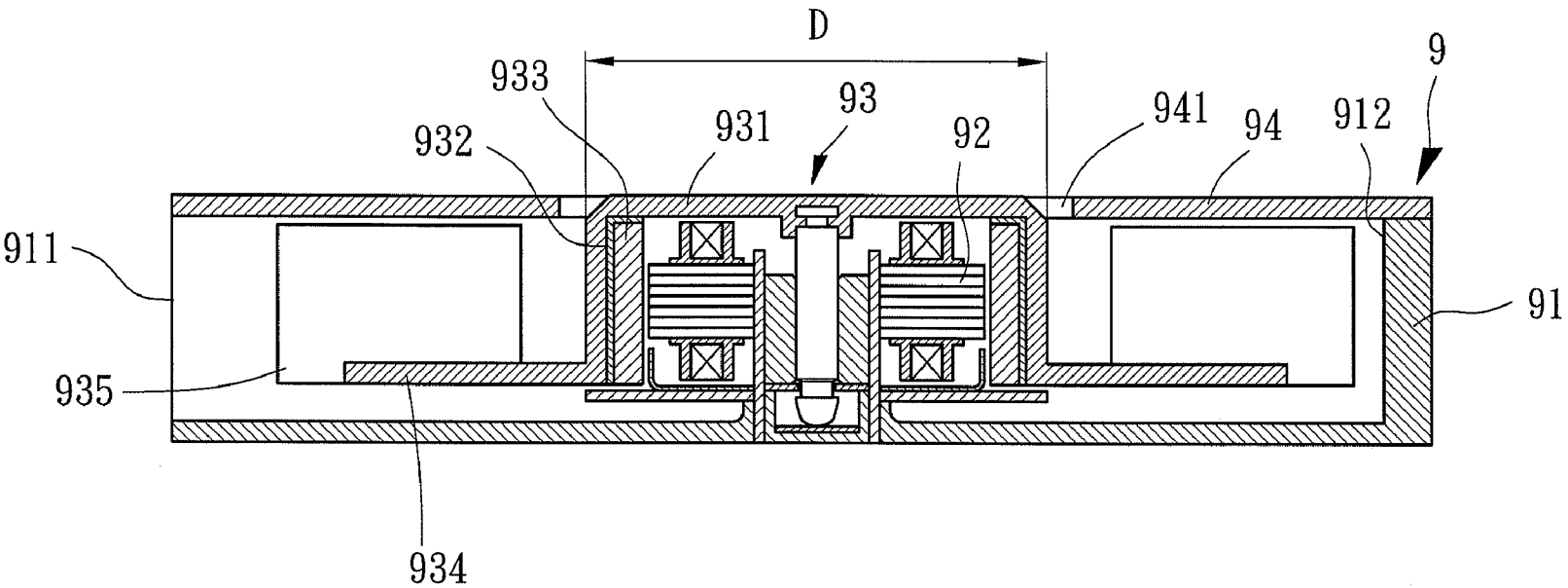
FIG. 2 PRIOR ART
FIG. 2 shows a cross sectional view of the miniature fan of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "section", "axial", "radial", "horizontal", "annular", "outward", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 3:
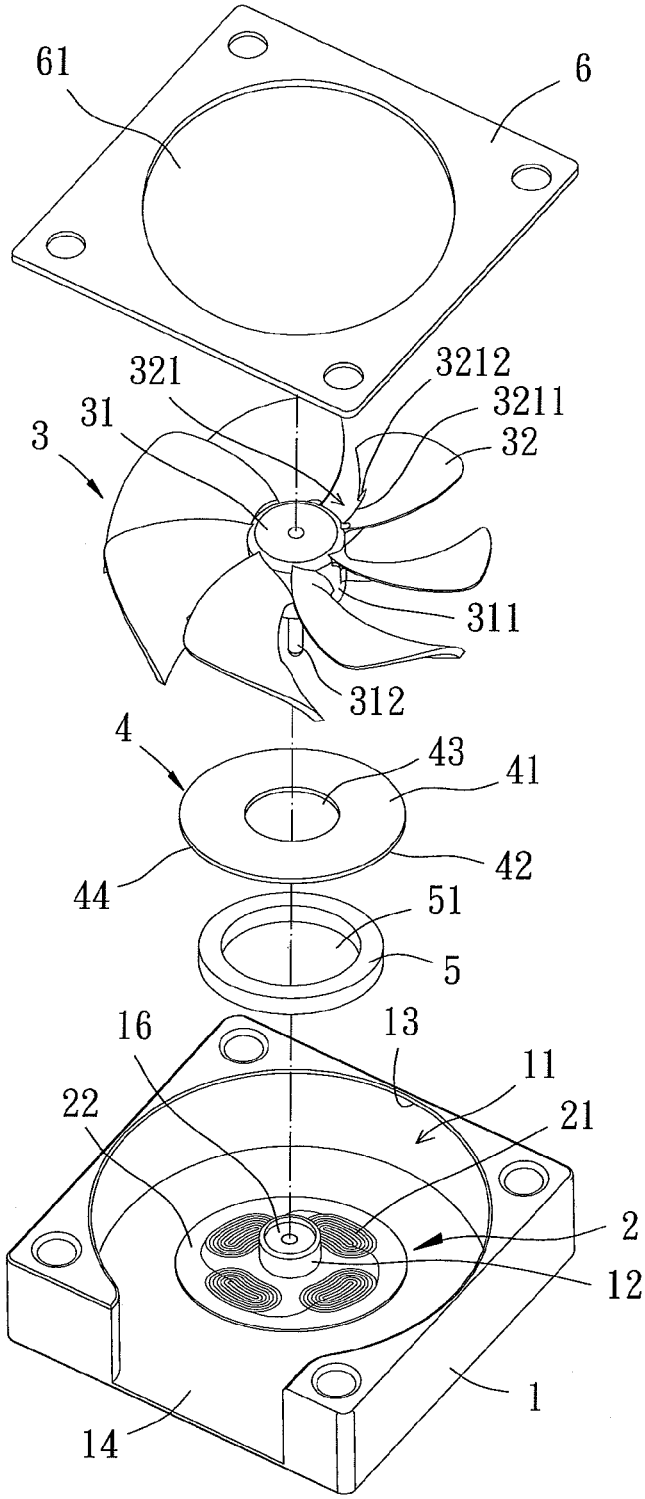
FIG. 3 shows an exploded, perspective view of a miniature fan of a first embodiment according to the preferred teachings of the present invention.
Figure 4:
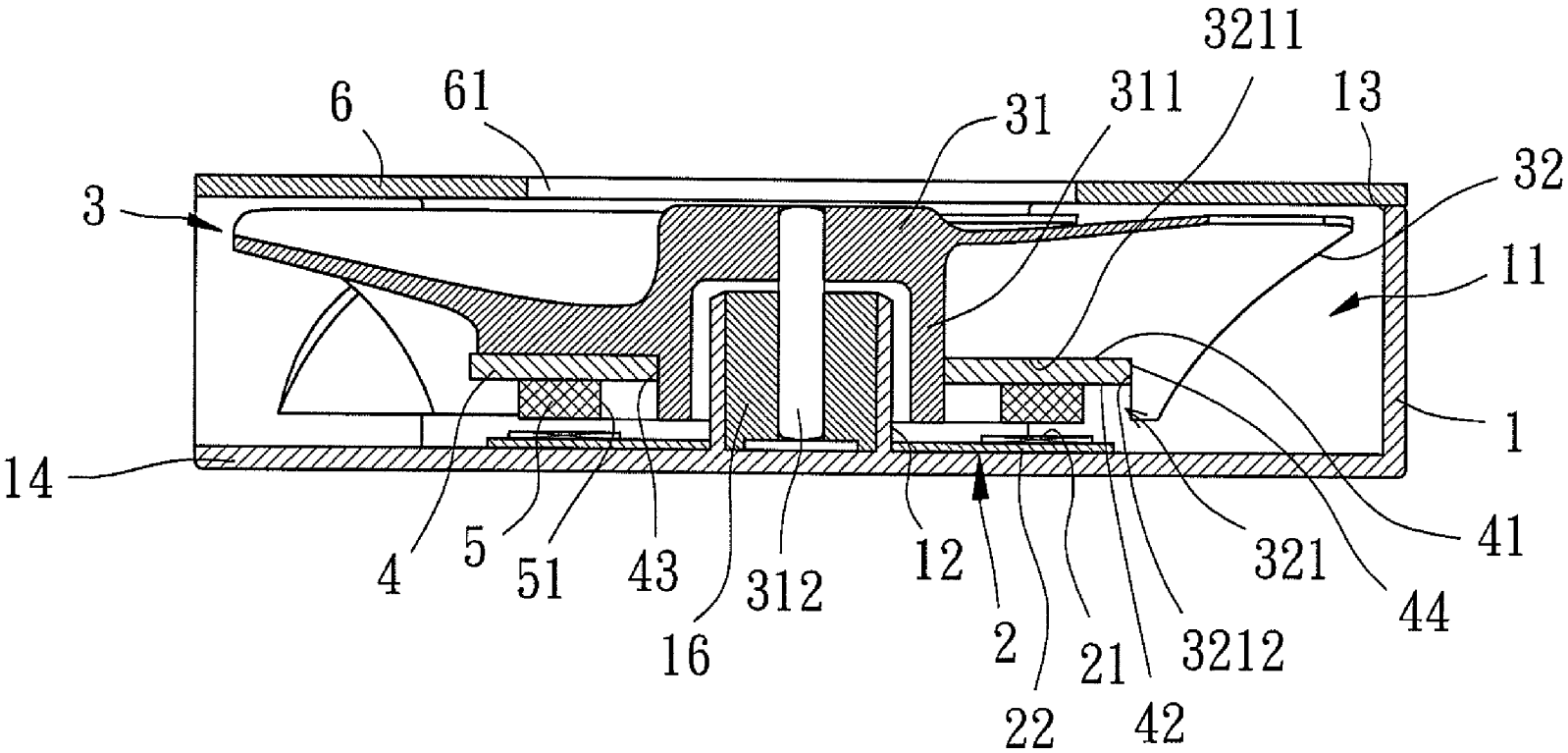
FIG. 4 shows a cross sectional view of the miniature fan of FIG. 3.

A miniature fan of a first embodiment according to the preferred teachings of the present invention is shown in FIGS. 3 and 4 of the drawings. According to the preferred form shown, the miniature fan includes a base 1, a stator 2, a rotor 3, a magnetically sealing ring 4, a permanent magnet 5, and a cover 6. Base 1 includes a compartment 11 and a shaft tube 12 mounted in compartment 11 and receiving a bearing 16. Base 1 further includes an opening 13 in a top side thereof and an air outlet 14 in a lateral side thereof perpendicular to the top side. Opening 13 and air outlet 14 are in communication with compartment 11.

Stator 2 is mounted in compartment 11 of base 1 and includes a winding 21 According to the most preferred form shown, winding 21 is formed on a circuit board 22 by wiring so that stator 2 has a low profile in an axial direction of the miniature fan according to the preferred teachings of the present invention.

According to the preferred form shown, rotor 3 includes a hub 31 having an annular wall 311 extending in the axial direction and a plurality of blades 32 formed on an outer periphery of annular wall 311. It can be appreciated that annular wall 311 of hub 31 can be omitted, and blades 32 can be directly formed on an outer periphery of hub 31. Each blade 32 includes a notch 321 in a bottom edge thereof. Each notch 321 extends a predetermined distance from a root of the bottom edge of blade 32 in a radial direction perpendicular to the axial direction or is formed in a desired section of the bottom edge of blade 32. According to the preferred form shown, each notch 321 includes a bottom edge 3211 extending in the radial direction and an end edge 3212 extending perpendicularly from an end of bottom edge 3211. A shaft 312 extends in the axial direction and is mounted to a center of hub 31 and located inside annular wall 311. Shaft 312 is rotatably extended through bearing 16 of shaft tube 12 in base 1. Shaft tube 12 is received inside annular wall 311 of hub 31, preventing dust from entering an interior of shaft tube 12.

Magnetically sealing ring 4 is made of magnetically conductive material and includes first and second engaging faces 41 and 42 spaced in the axial direction and an outer periphery 44 extending between first and second engaging faces 41 and 42. Magnetically sealing ring 4 further includes a positioning hole 43 in a center thereof and extending from first engaging face 41 through second engaging face 42. Annular wall 311 of hub 31 is extended through positioning hole 43 of magnetically sealing ring 4 with first engaging face 41 abuts bottom edge 3211 of notch 321 of each blade 32 and with outer periphery 44 abuts end edge 3212 of notch 321 of each blade 32. This further reduces the height in the axial direction of the miniature fan according to the preferred teachings of the present invention. Preferably, an inner periphery of positioning hole 43 of magnetically sealing ring 4 is fixed to the outer periphery of annular wall 311 of hub 31 by tight coupling, adhesive or other suitable provisions, providing better coupling effect between rotor 3 and magnetically sealing ring 4. It can be appreciated that first engaging face 41 of magnetically sealing ring 4 can be engaged with bottom edge 3211 of notch 321 of each blade 32 by tight coupling, adhesive or other suitable provisions. Similarly, outer periphery 44 of magnetically sealing ring 4 can be engaged with end edge 3212 of notch 321 of each blade 32 by tight coupling, adhesive or other suitable provisions.

According to the preferred form shown, permanent magnet 5 includes a through-hole 51 in a center thereof. Annular wall 311 of hub 31 of rotor 3 is extended through through-hole 51 of permanent magnet 5. Furthermore, permanent magnet 5 is fixed to second engaging face 42 of magnetically sealing ring 4 and aligned with winding 21 of stator 2.

According to the preferred form shown, cover 6 is mounted on the top side of base 1 and includes an air inlet 61 aligned with opening 13 of base 1. However, cover 6 can be omitted to further reduce the overall height in the axial direction of the miniature fan according to the preferred teachings of the present invention and to provide a simpler structure allowing easier assembly.

In use, winding 21 is supplied with electricity to increate flux linkage between stator 2 and permanent magnet 5 to rotate rotor 3. Airflow is drawn into miniature fan via air inlet 61 and driven by blades 32 of rotor 3 to the environment after passing through air outlet 14 of base 1, providing heat-dissipating effect.

Given the same air output, since first engaging face 41 of magnetically sealing ring 4 is coupled to bottom edges 3211 of blades 32 and since permanent magnet 5 is directly coupled to second engaging face 42 of magnetically sealing ring 4, the overall volume of the miniature fan according to the preferred teachings of the present invention is smaller than conventional miniature fans.

Figure 5:
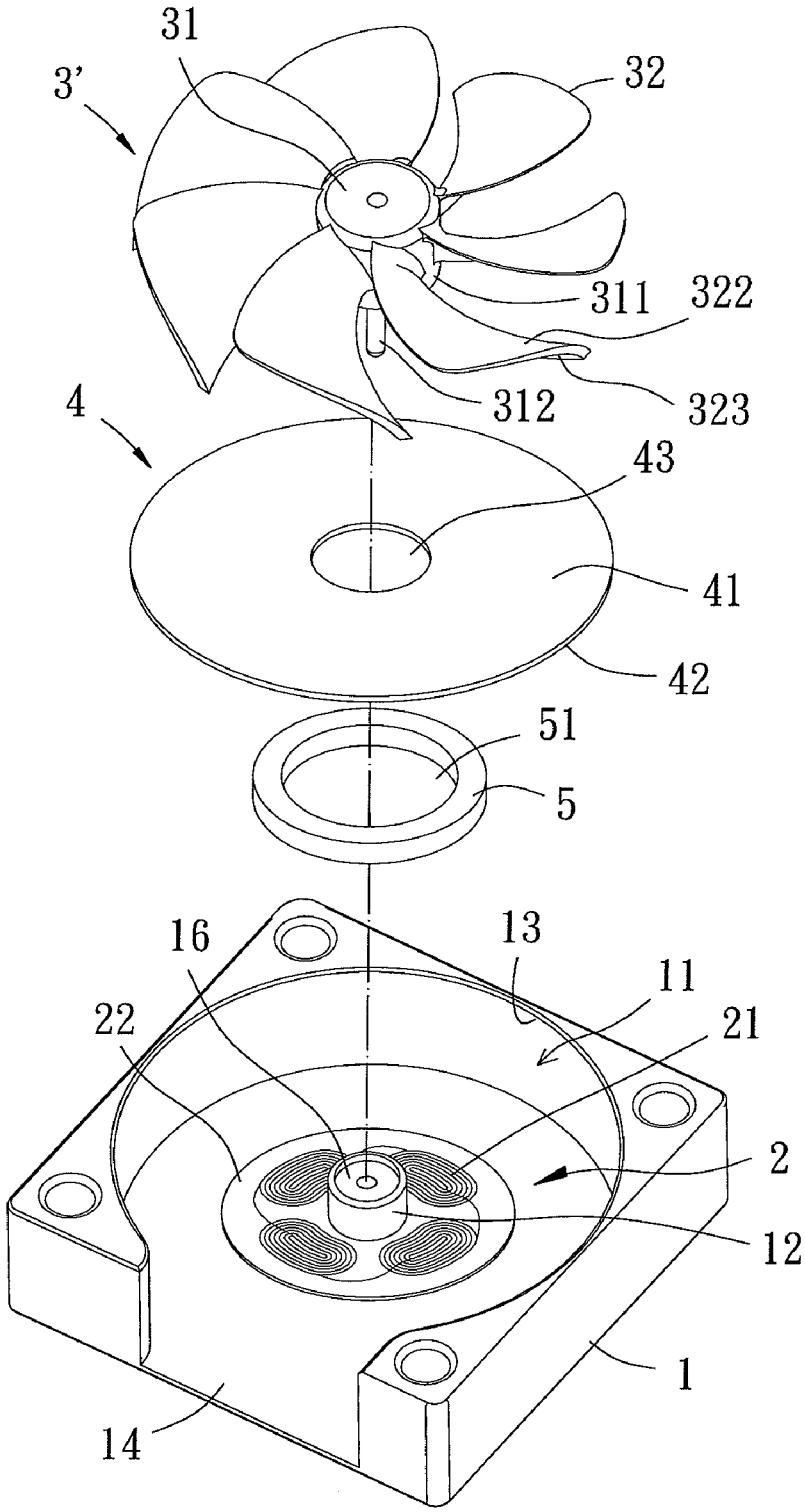
FIG. 5 shows an exploded, perspective view of a miniature fan of a second embodiment according to the preferred teachings of the present invention.
Figure 6:
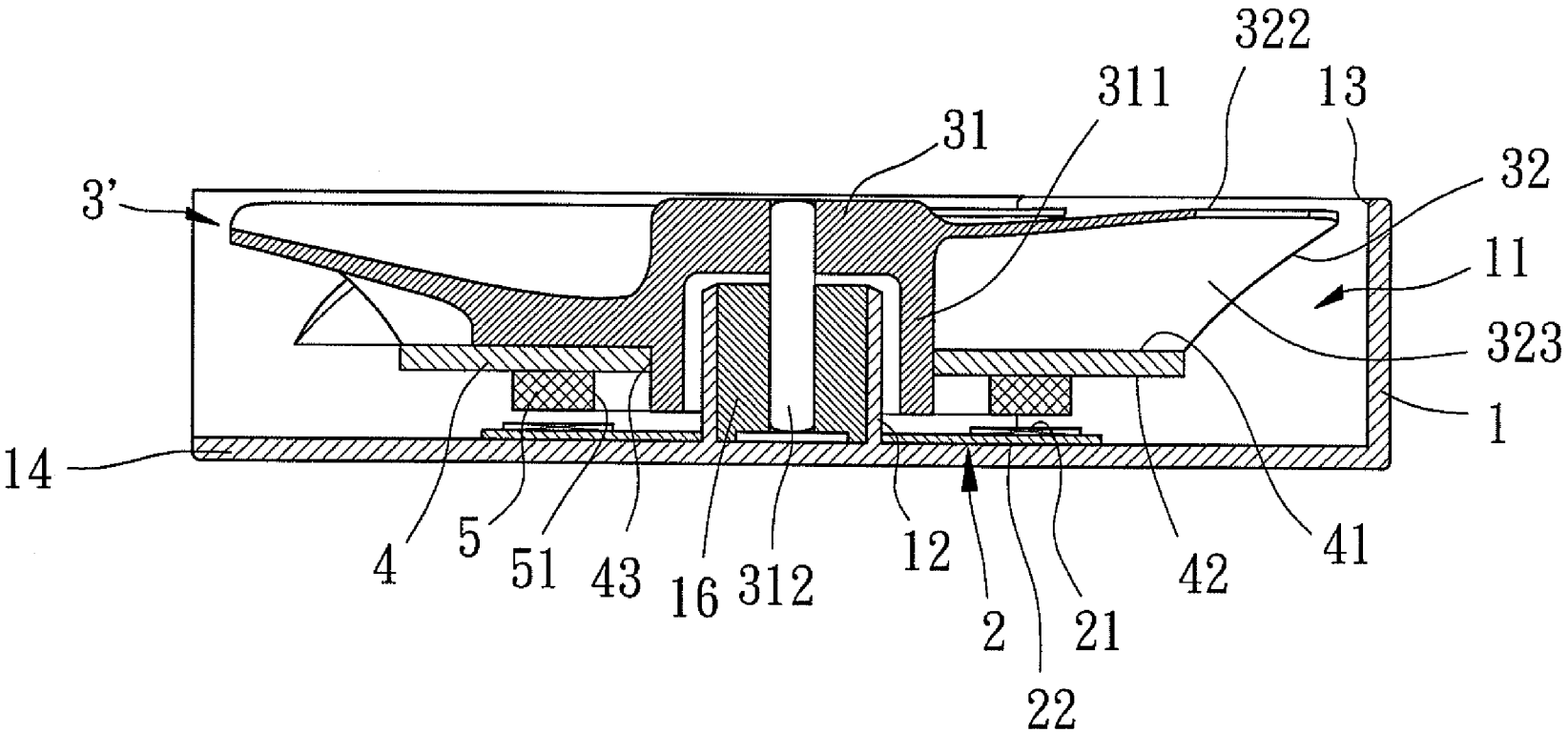
FIG. 6 shows a cross sectional view of the miniature fan of FIG. 5.

FIGS. 5 and 6 show a miniature fan of a second embodiment according to the preferred teachings of the present invention. According to the preferred form shown, the miniature fan includes a base 1, a stator 2, a rotor 3', a magnetically sealing ring 4, and a permanent magnet 5, wherein base 1, stator 2, and permanent magnet 5 identical to those in the first embodiment are not described in detail to avoid redundancy. It can be appreciated that cover 6 of the first embodiment is omitted in this embodiment to reduce the axial height of the miniature fan and to allow easier assembly.

According to the preferred form shown, rotor 3' includes a hub 31 having an annular wall 311 extending in the axial direction and a plurality of blades 32 formed on an outer periphery of annular wall 311. It can be appreciated that annular wall 311 of hub 31 can be omitted, and blades 32 can be directly formed on an outer periphery of hub 31. A shaft 312 is mounted to a center of hub 31 and located inside annular wall 311. Shaft 312 is rotatably extended through bearing 16 of shaft tube 12 in base 1. Shaft tube 12 is received inside annular wall 311 of hub 31. Each blade 32 includes an air inlet side 322 and an air driving side 323. Note that notch 321 in the bottom edge of each blade 32 in the first embodiment is omitted. Magnetically sealing ring 4 is coupled to the bottom edge of each blade 32, and permanent magnet 5 is directly coupled to second engaging face 42 of magnetically sealing ring 4.

Figure 7:
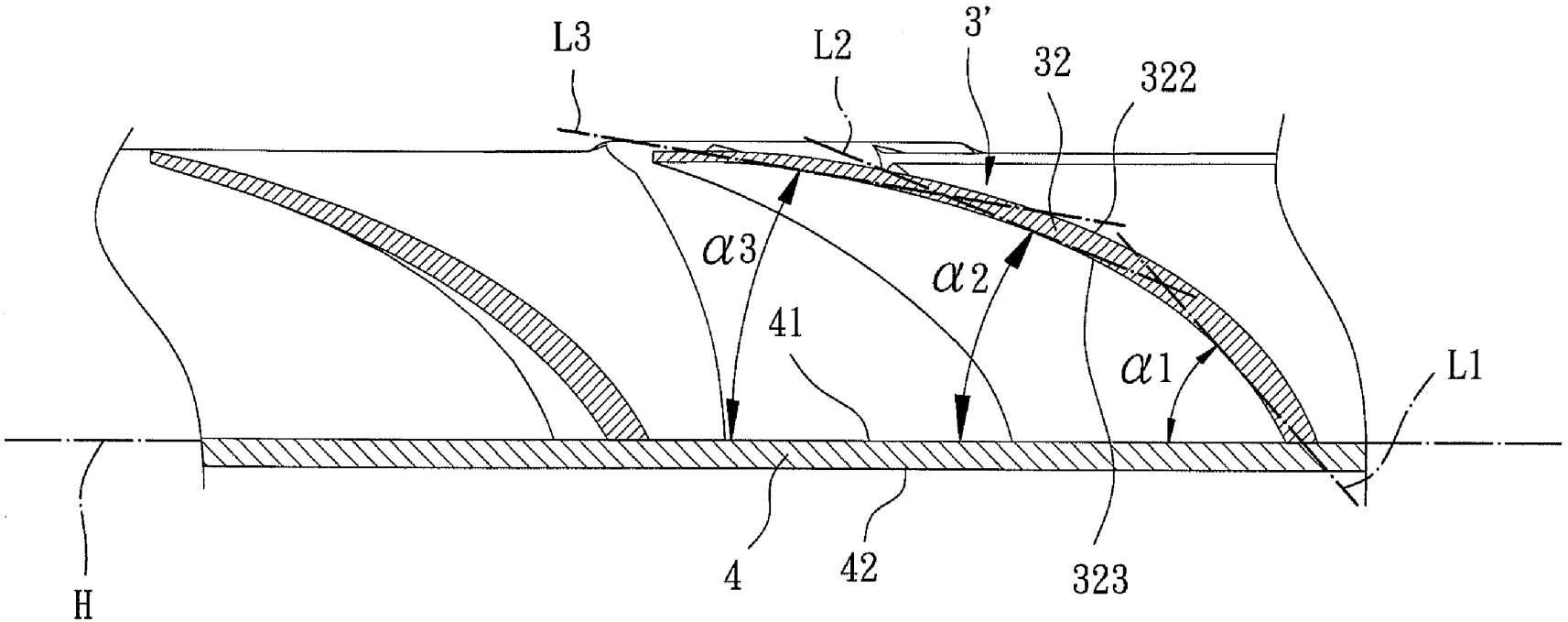
FIG. 7 shows a partial, enlarged, cross sectional view of the miniature fan of FIG. 5.

With reference to FIG. 7, air driving side 323 of each blade 32 is at an angle larger than 10° and smaller than 90° to a horizontal plane H on which first engaging face 41 of magnetically sealing ring 4 lies. By such an arrangement, an airflow accumulation area is formed between air driving side 323 of each blade 32 and first engaging face 41 of magnetically sealing ring 4 so that airflow can be directly driven into the airflow accumulation area by rotation of rotor 3' and then driven by air driving sides 323 of blades 32 of rotor 3 to the environment after passing through air outlet 14 of base 1, providing heat-dissipating effect.

Air driving side 323 of each blade 32 is preferably a concave face. Furthermore, an angle $\alpha 1$, $\alpha 2$, $\alpha 3$ between any tangent L1, L2, L3 of air driving side 323 and horizontal plane H on which first engaging face 41 of magnetically sealing ring 4 lies is an acute angle smaller than 90° and preferably larger than 10° to allow more effective accumulation of airflow in the airflow accumulation area, increasing the air output.

In the second embodiment, the overall volume of the miniature fan according to the preferred teachings of the present invention is reduced by coupling first engaging face 41 of magnetically sealing ring 4 to the bottom edge of each blade 32 and by directly coupling permanent magnet 5 to second engaging face 42 of magnetically sealing ring 4. Furthermore, by providing the airflow accumulation area between air driving side 323 of each blade 32 and first engaging face 41 of magnetically sealing ring 4, airflow can be easily guided into the airflow accumulation area.

As mentioned above, given the same air output, the overall volume of the miniature fan according to the preferred teachings of the present invention is effectively reduced by coupling first engaging face 41 of magnetically sealing ring 4 to the bottom edge of each blade 32 and by directly coupling permanent magnet 5 to second engaging face 42 of magnetically sealing ring 4.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A miniature fan comprising:

a base including a compartment, with a shaft tube being mounted in the compartment, with the base further including an opening in a top side thereof and an air outlet in a lateral side thereof, with the opening and the air outlet being in communication with the compartment; a stator mounted in the compartment of the base;

a rotor including a hub and a shaft mounted to the hub, with the shaft rotatably extending through the shaft tube of the base in an axial direction, with a plurality of blades formed on, extending radially outward of and circumferentially spaced on an outer periphery of the hub, with each of the plurality of blades including a bottom edge extending radially outward of the hub;

a magnetically sealing ring including first and second engaging faces spaced in the axial direction, with the first engaging face being coupled to the bottom edge of each of the plurality of blades, with the magnetically sealing ring further including a positioning hole through which the outer periphery of the hub extends; and a permanent magnet coupled to the second engaging face of the magnetically sealing ring and aligned with the stator.

2. The miniature fan as claimed in claim 1, with the hub including an annular wall extending in the axial direction and including the outer periphery, and with the shaft and the shaft tube being received inside the annular wall.

3. The miniature fan as claimed in claim 2, with the positioning hole of the magnetically sealing ring having an inner periphery fixed to the outer periphery of the annular wall of the hub.

4. The miniature fan as claimed in claim 1, with the permanent magnet including a through-hole in a center thereof, and with the hub extending through the through-hole of the permanent magnet.

5. The miniature fan as claimed in claim 1, with the bottom edge of each of the plurality of blades of the rotor including a notch, and with the magnetically sealing ring engaged in the notch of the bottom edge of each of the plurality of blades.

6. The miniature fan as claimed in claim 5, with the notch of each of the plurality of blades including a bottom notch edge and an end notch edge, with the first engaging face of the magnetically sealing ring abutting the bottom notch edge of the notch of each of the plurality of blades, and with the magnetically sealing ring further including an outer periphery extending between the first and second engaging faces and abutting the end notch edge of the notch of each of the plurality of blades.

7. The miniature fan as claimed in claim 6, with the bottom notch edge of the notch of each of the plurality of blades extending in a radial direction perpendicular to the axial direction, and with the end notch edge extending perpendicularly from an end of the bottom notch edge.

8. The miniature fan as claimed in claim 1, further comprising a cover mounted on the top side of the base, with the cover including an air inlet aligned with the opening of the base.

9. A miniature fan comprising:

a base including a compartment, with a shaft tube being mounted in the compartment, with the base further including an opening in a top side thereof and an air outlet in a lateral side thereof, with the opening and the air outlet being in communication with the compartment; a stator mounted in the compartment of the base;

a rotor including a hub and a shaft mounted to the hub, with the shaft rotatably extending through the shaft tube of the base in an axial direction, with a plurality of blades formed on, extending radially outward of and circumferentially spaced on an outer periphery of the hub, with each of the plurality of blades including a bottom edge extending radially outward of the hub;

a magnetically sealing ring including first and second engaging faces spaced in the axial direction, with the first engaging face being coupled to the bottom edge of each of the plurality of blades, with the magnetically sealing ring further including a positioning hole through which the hub extends, with an angle between the air driving side of each of the plurality of blades and a horizontal plane on which the first engaging face of the magnetically sealing ring lies being larger than 10° and smaller than 90°; and a permanent magnet coupled to the second engaging face of the magnetically sealing ring and aligned with the stator.

10. The miniature fan as claimed in claim 9, with the hub including an annular wall extending in the axial direction and including the outer periphery, and with the shaft and the shaft tube being received inside the annular wall.

11. The miniature fan as claimed in claim 10, with the positioning hole of the magnetically sealing ring having an inner periphery fixed to the outer periphery of the annular wall of the hub.

12. The miniature fan as claimed in claim 9, with the permanent magnet including a through-hole in a center thereof, and with the hub extending through the through-hole of the permanent magnet.

13. The miniature fan as claimed in claim 9, with the bottom edge of each of the plurality of blades of the rotor including a notch, and with the magnetically sealing ring engaged in the notch of the bottom edge of each of the plurality of blades.

14. The miniature fan as claimed in claim 13, with the notch of each of the plurality of blades including a bottom notch edge and an end notch edge, with the first engaging face of the magnetically sealing ring abutting the bottom notch edge of the notch of each of the plurality of blades, and with the magnetically sealing ring further including an outer periphery extending between the first and second engaging faces and abutting the end notch edge of the notch of each of the plurality of blades.

15. The miniature fan as claimed in claim 14, with the bottom notch edge of the notch of each of the plurality of blades extending in a radial direction perpendicular to the axial direction, and with the end notch edge extending perpendicularly from an end of the bottom notch edge.

16. The miniature fan as claimed in claim 15, with the air driving side of each of the plurality of blades being a concave face, with an angle between any tangent of the air driving side of each of the plurality of blades and the horizontal plane being larger than 10° and smaller than 90°.

17. The miniature fan as claimed in claim 9, with the air driving side of each of the plurality of blades being a concave face, with an angle between any tangent of the air driving side of each of the plurality of blades and the horizontal plane being larger than 10° and smaller than 90°.

* * * * *